US005622110A

United States Patent [19]

Orzechowski et al.

[11] Patent Number: 5,622,110

[45] Date of Patent: Apr. 22, 1997

[54] PRINTING PRESS WITH DAMPENING LIQUID SPRAY CONTROL APPARATUS AND METHOD

[75] Inventors: Thomas W. Orzechowski, Cicero; Thaddeus A. Niemiro, Lisle, both of Ill.

[73] Assignee: Goss Graphic Systems, Inc., Westmont, Ill.

[21] Appl. No.: 557,243

[22] Filed: Nov. 14, 1995

Related U.S. Application Data

[63] Continuation of Ser. No. 310,010, Sep. 21, 1994, abandoned, which is a continuation of Ser. No. 23,219, Feb. 25, 1993, abandoned.

[51] Int. Cl.[6] ..... B41F 7/26; B41F 7/30

[52] U.S. Cl. ..... 101/148; 101/366

[58] Field of Search ..... 101/147, 148, 101/366, 350; 239/222, 222.17, 222.19, 122; 118/313, 314, 300; 222/286, 291, 292, 544

[56] References Cited

U.S. PATENT DOCUMENTS

| | | | |
|---|---|---|---|
| 2,448,226 | 8/1948 | Marsden | 101/147 |
| 3,924,531 | 12/1975 | Klingler | 101/147 |
| 4,044,667 | 8/1977 | Smith, Jr. | 101/148 |
| 5,014,615 | 5/1991 | Lin et al. | 101/147 |

*Primary Examiner*—J. Reed Fisher
*Attorney, Agent, or Firm*—Potthast & Ring

[57] ABSTRACT

A printing press (10) with a dampener roller (16) and a spray bar assembly (12) for spraying dampening liquid (20) onto the dampener roller is provided with a dampening liquid spray control apparatus (15) including a control member (18) with a diagonal blocking section (40) for blocking dampening liquid (20) from impinging upon selected locations on the dampener roller (16) when there is a relatively narrow web running in the press and a transverse deflecting section (42) for deflecting dampening liquid (20) onto the dispenser roller at preselected locations adjacent the end of the dampener roller (16A) when a relatively wider web is running in the press to reduce scumming and an adjustable mounting apparatus (24, 26, 28, 30, 31, 34 and 37) to mount the control member (18) in different positions to achieve different dampening results.

19 Claims, 4 Drawing Sheets

PRINTING PRESS WITH DAMPENING LIQUID SPRAY CONTROL APPARATUS AND METHOD

This is a continuation of application Ser. No. 03/310,010 filed Sep. 21, 1994, now abandoned, which is a continuation of application Ser. No. 08/023,219, filed Feb. 25, 1993, now abandoned.

BACKGROUND OF THE INVENTION

1. Field of the Invention

This invention generally relates to an offset, rotary, printing press and, particularly, to such a press with a spray bar assembly for spraying dampening liquid onto a roller.

2. Description of the related art including information disclosed under 37 CFR 1.97–1.99

It is well known in high speed offset printing presses to add dampening liquid to the printing plate mounted on a plate cylinder by means of a train of dampening liquid rollers. The train of rollers includes a dampener roller upon which dampening liquid is sprayed from an elongate spray bar assembly. The elongate spray bar assembly has a plurality of solenoid controlled nozzles spaced along the length of an elongate, generally U-shaped open housing which collectively spray dampening liquid along the length of the roller body.

It is also known to provide a pair of stop plates at opposite ends of the open housing to deflect liquid spraying diagonally from the end nozzles onto the edge of the dampening roller which would otherwise spray beyond the edge. The increased dampening liquid at the edge of the dampener roller resulting from the deflection helps remove ink scumming at the edges of the dampening rollers.

Disadvantageously, optimal spray density to reduce edge scumming is obtained in those known presses only when the width of the paper web, or width of the printing plate, corresponds to the fixed location of the stop plate. When a relatively smaller printing plate is employed, a different spray pattern is required, but in the known printing press it was not possible to adjust the mounting location of the stop plate to obtain different spray patterns or to make any adjustment whatsoever to the spray pattern during operation of the press.

Since it is not possible to make adjustments to the spray during operation, it is not possible to empirically determine the optimum spray setting by making adjustments to the spray pattern during operation for different sized printing plates and webs.

SUMMARY OF THE INVENTION

It is therefore the principal object of the invention to provide a printing press having an elongate spray bar with an dampening liquid spray control apparatus and methods to selectively vary the spray pattern for different operating conditions and to overcome the disadvantages of the prior art and to selectively block spraying dampening liquid from impinging upon a roller.

This object is achieved in part by providing a printing press, having a plate cylinder with a body extending between a pair of opposed ends for supporting a printing plate, a roller and an elongate spray bar assembly with a plurality of spaced nozzles for collectively spraying dampening liquid along the length of the roller, with a dampening liquid spray control apparatus comprising a dampening liquid control member and means for mounting the dampening liquid control member intermediate at least one of the nozzles and the roller to selectively block at least some of the sprayed dampening liquid from impinging at a preselected location upon the roller.

The object of the invention is also obtained in part by providing a printing press, having a plate cylinder with a body extending between a pair of opposed ends for supporting a printing plate, a roller and an elongate spray bar assembly with a plurality of spaced nozzles for collectively spraying dampening liquid along the length of the roller, with a dampening liquid spray control apparatus comprising a dampening liquid control member and means for mounting the dampening liquid control member for movement between different positions to selectively divert at least some of the dampening liquid spraying from the nozzles onto different parts of the roller.

Preferably, the mounting means of the printing press includes means for adjustably mounting the dampening liquid control member for movement to different selected positions at which different amounts of the sprayed dampening liquid are blocked by the control member from impinging at different corresponding preselected locations upon the dampening roller.

Preferably, the control member of the printing press has a blocking section for blocking sprayed dampening liquid from the roller and a deflection section and the mounting means includes means for mounting the control member for movement to a nonblocking position in which spraying dampening liquid is deflected by the deflection section onto the dampening roller and vice versa.

Obtainment of the object of the invention is achieved further by providing, in a printing press having a plate cylinder with a body extending between a pair of opposed ends for supporting a printing plate, a roller and an elongate spray bar assembly with a plurality of spaced nozzles for collectively spraying dampening liquid along the length of the roller, a method of controlling the direction of at least some of the dampening liquid sprayed toward the dampening roller comprising the steps of (1) spraying dampening liquid toward a preselected location on the roller and (2) blocking at least some of the dampening liquid sprayed toward the preselected location from impinging upon the roller.

Preferably, the method includes the step of deflecting at least some of the dampening liquid onto the roller when the printing press is printing on a relatively wide paper web, compared to a web being run when the step of blocking is performed, in lieu of blocking the sprayed dampening liquid, to reduce scumming adjacent the edge of the web.

The object of the invention is also obtained by providing, in a printing press having a plate cylinder with a body extending between a pair of opposed ends for supporting a printing plate, a roller and an elongate spray bar assembly with a plurality of spaced nozzles for collectively spraying dampening liquid along the length of the roller, a method of selectively controlling the direction of at least some of the dampening liquid sprayed toward the roller, comprising the steps of (1) movably mounting a control member intermediate the nozzles and the roller for adjustment to different positions along the length of the spray bar assembly and (2) selectively adjusting the movably mounted control member to said different positions to selectively divert at least some of the spraying dampening liquid onto corresponding different parts of the roller.

Advantageously, the step of adjusting is performed while the press continues running to enable adjustments based on observed results until an optimum position has been achieved.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1A:
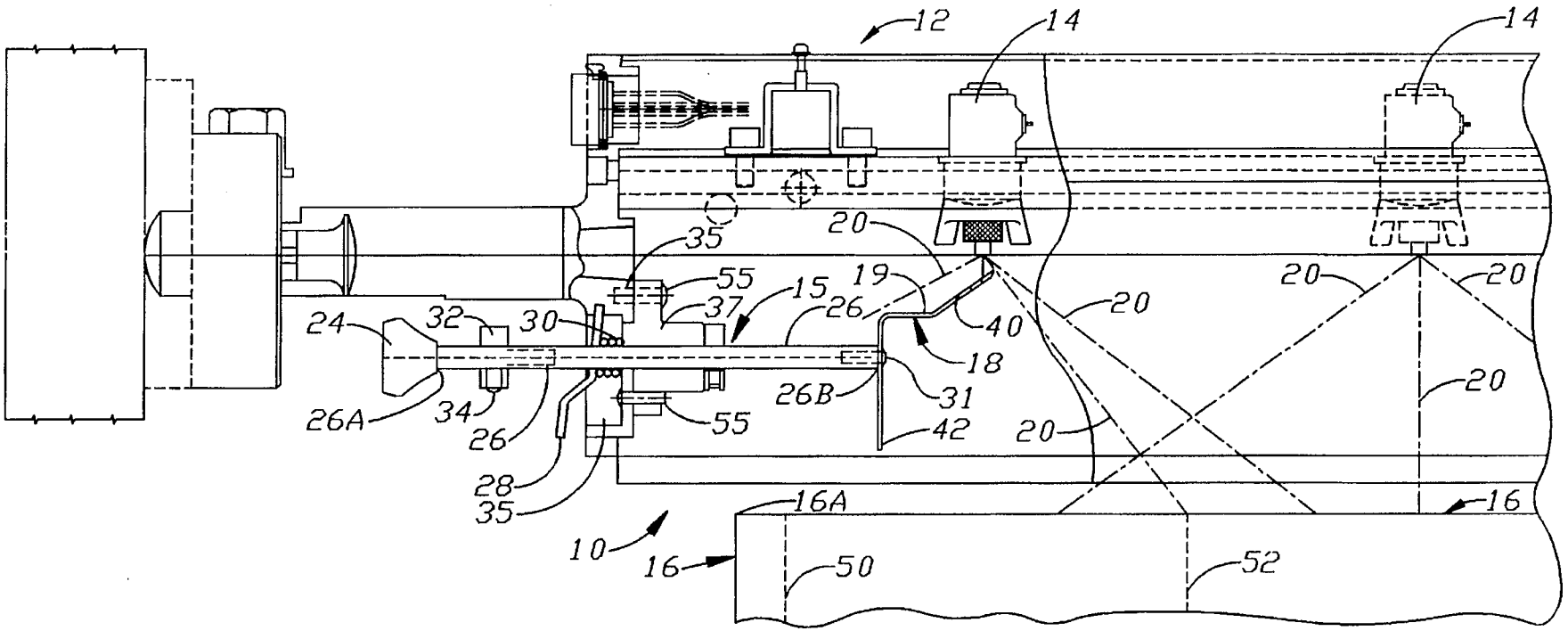
FIG. 1A is a side view of one end of the preferred embodiment of the elongate spray bar assembly in the printing press of the present invention with a part broken away to illustrate the liquid spray control apparatus in the dispensing liquid spray blocking position.
Figure 1B:
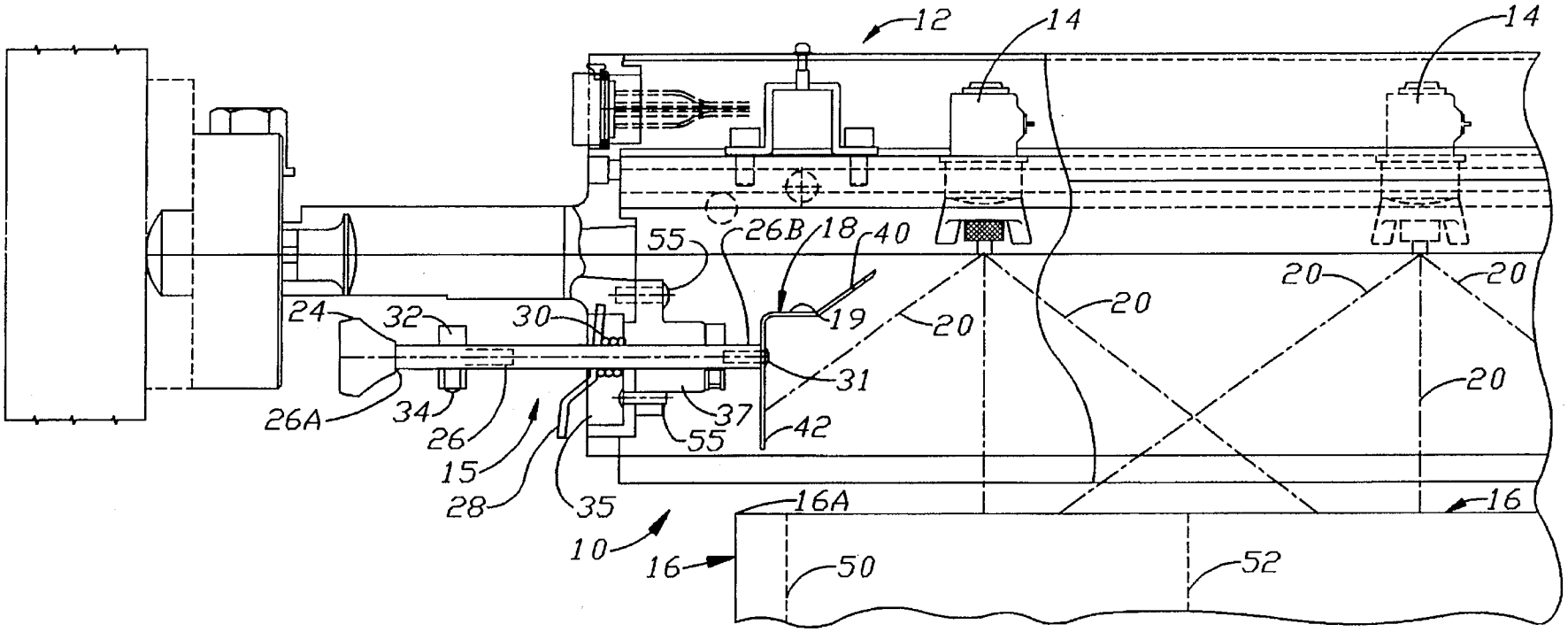
FIG. 1B is a side view of the one same end of the preferred embodiment of the elongate spray bar assembly in the printing press of the present invention with a portion broken away to illustrate the liquid spray control apparatus in a dispensing liquid spray directing position.

Referring to FIGS. 1A and 1B, the preferred embodiment of one end of the printing press 10 of the present invention is seen to include an elongate spray bar assembly 12 with a plurality of spaced nozzles 14 for collectively spraying dampening liquid along the length of a dampener roller 16. While only one end is shown, it should be understood that the other end of the printing press and spray bar assembly 12 is a mirror image of the one end shown in FIGS. 1A–2B. The dampener roller is any roller in the train of dampening rollers upon which dampening liquid 20 is sprayed from the elongate spray bar assembly 12. The printing press 10 has a plate cylinder, not shown, with a body extending between a pair of opposed ends for supporting a printing plate. Ink is transferred onto the printing plate of the plate cylinder through an inking train of rollers. A web of paper is rolled through the cylinder and an ink image is then transferred from the printing plate to a blanket cylinder and, in turn, to a paper web. The width of the web generally corresponds to the width of the printing plate. For further details of an exemplary printing press system with a plate cylinder and an inking train of rollers, which form no part of the present invention, reference can be made to U.S. Pat. No. 5,107,762 of Fadner et al. entitled "Ink Dampener For Lithographic Printing Press" issued Apr. 28, 1992, and U.S. Pat. No. 4,684,925 of Van Kanegan et al. entitled "Simplified Lithography Using Ink and Water Admixtures" issued Sep. 12, 1989.

The dampening liquid spray control apparatus 15 includes a special dampening liquid control member 18. As seen in FIG. 1A, the dampening liquid control member 18 is intermediately mounted in the spray bar assembly 12 between the nozzles 14 and the dampener roller 16 to selectively block at least some of the dampening liquid 20 from impinging at a preselected location upon the dampener roller 16. Alternatively, as seen in FIG. 1B, the dampening liquid control member 18 is mounted in the liquid spray control apparatus 15 to selectively deflect at least some of the dampening liquid 20 sprayed from the nozzles 14 onto different parts of the dampener roller 16. The different locations 50, 52 on the dampener roller 16 correspond to the edges of different paper webs having different widths in the printing press system 10.

The dampening liquid control member 18 is adjustably mounted for movement to different selected positions relative to a nozzle 14. Different amounts of the sprayed dampening liquid 20 are either deflected onto or blocked from impinging on a preselected location upon the dampener roller 16 depending on the selected position of the control member 18. The control member 18 is mounted to end 26B of an elongate support member 26 by means of a screw 31. The elongate support member 26 is supported in the elongate spray bar assembly 12 by a bearing support 37 connected to an end plate 35 of the spray bar assembly 12 by support screws 55. The elongate support member 26 is fitted through a bore of the bearing support for adjustably mounting the support member and the connected control member 18 within an interior location of the spray bar assembly 12.

Referring to FIGS. 1A, 1B, 3A and 3B, the control member 18 has a blocking section 40 for blocking the sprayed dampening liquid 20 and a deflection section 42 for deflecting the sprayed dampening liquid toward an end 16A of the dampener roller 16. Referring again to FIG. 1B, the dampening liquid control member 18 is mounted in a nonblocking position in which the spraying dampening liquid 20 is deflected by the deflection section 42 of the control member 18 and onto the dampening roller 16. The deflection of the liquid 20 enables increased volume of dampening liquid to be directed by the deflecting section 42 at an end location 16A of the roller 16 to clean away the scumming build up of ink at the edge of the rollers when a relatively wide paper web with an edge 50 adjacent the end 16A is being run. The deflecting section concentrates the spray of liquid 20 and directs it to this preselection position on the roller. Alternatively, as seen in FIG. 1A, in obtaining another objective of the invention, the movably mounted control member 18 is adjustably moved to a nondeflecting position in which the blocking section 40 of the control member 18 blocks at least some of the sprayed dampening liquid 20 from the dampener roller 16. The blocking section 40, FIG. 3A, of the control member 18 extends diagonally relative to the elongate direction of the spray bar assembly 12 and relative to the deflecting section 42. The blocking section 40 extends into the spray pattern of the end of one of the spray nozzles 14, FIG. 1A, to block at least some of the sprayed dampening liquid from contacting the dampener roller 16 between the end 16A and the edge of a web 52 when a relatively smaller web is being run.

While the elongate support member 26 holds the control member 18 in a position which is intermediate the opposed ends of the dampener roller 16, an actuator 24 connected at one end 26A of an elongate support member 26 provides means for conveying movement force to the elongate support member 26 from a position adjacent the end 16A of the dampener roller; this feature advantageously enables adjustment of the control member 18 during operation of the press.

The elongate support member 26 is releasably locked in any selected position between the extremes of its movement by means of a movably mounted binding member 28 and a spring 30 for biasing the binding member 28 into binding relationship with the elongate support member 26 to hold it in a selected position. The spring 30 engages the binding member 28 to frictionally lock the binding member 28 against the elongate support member 26. Finger pressure applied to binding member 28 manually releases the binding engagement of the binding member 28 with the elongate support member 26 to enable sliding movement of the elongate support member 28.

Figure 2A:
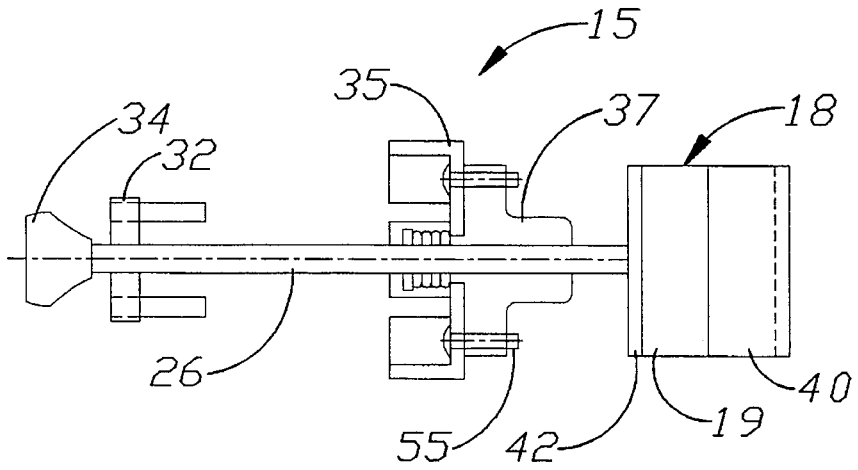
FIG. 2A is a reduced, simplified bottom view of the liquid spray control apparatus of FIG. 1A in the liquid spray blocking position.
Figure 2B:
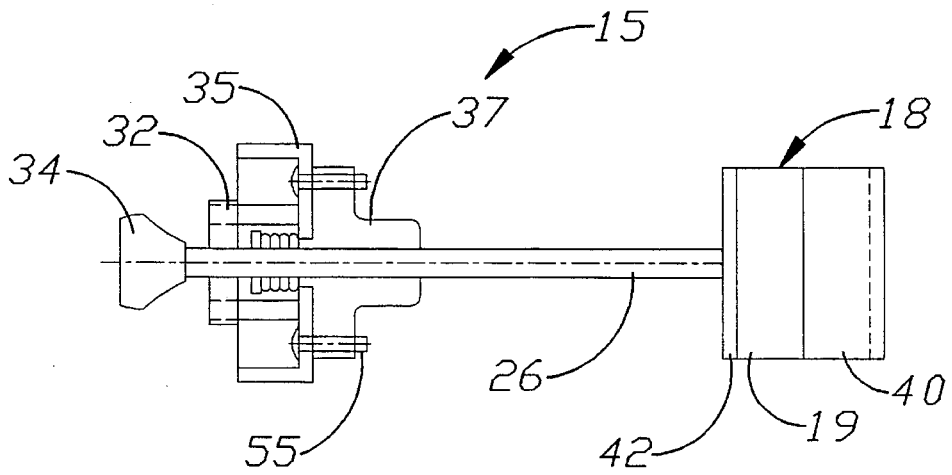
FIG. 2B is a reduced, simplified bottom view of the liquid spray control apparatus of Fig. 1B in the liquid spray diverting position.
Figure 3B:
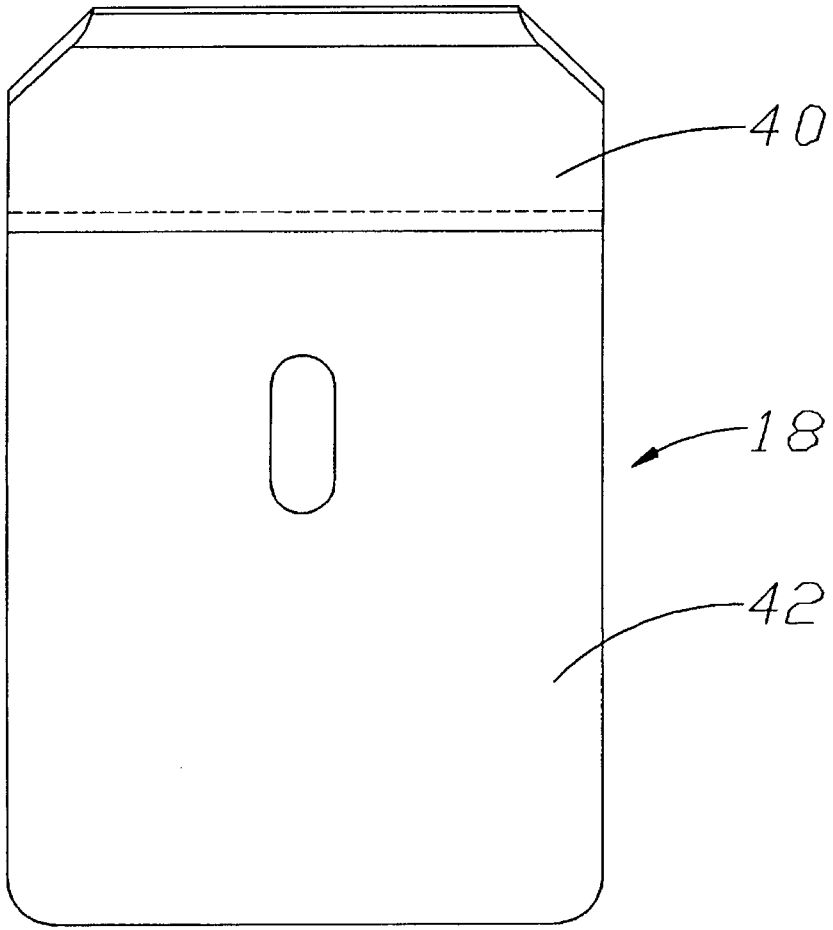
FIG. 3B is an enlarged front view of the dampening liquid control member of FIG. 3A.
Figure 3A:
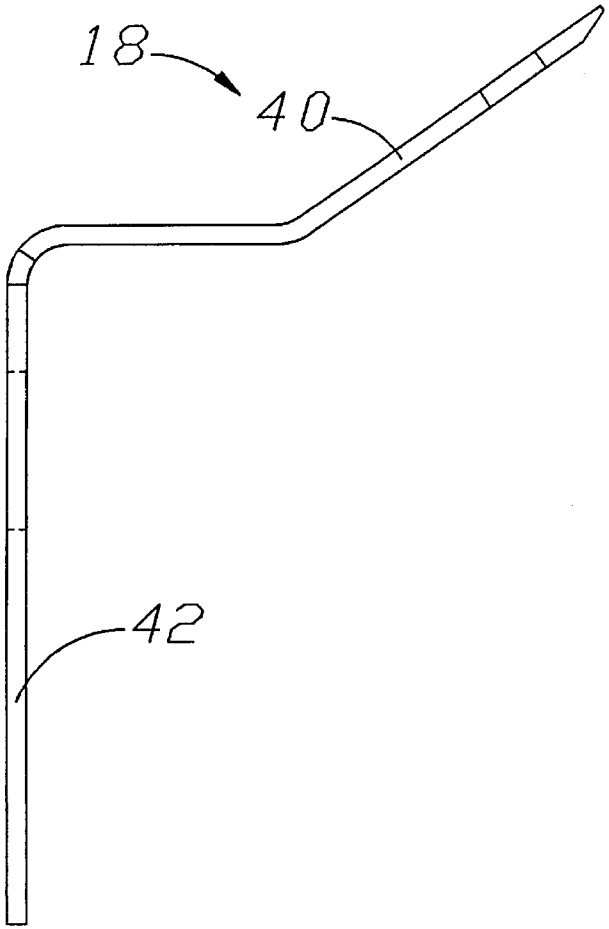
FIG. 3A is an enlarged side view of the preferred form of dampening liquid control member.

Referring to FIGS. 2A and 2B, the elongate support member 26 carries a stop member 32 at a preselected point along its length to provide a preselected limit to the inward sliding movement of the elongate support member 26. Preferably, the stop member 32 limits movement beyond a point where all the spray from the end nozzle is blocked, for in such a case, at least with respect to the end nozzle 14, the solenoid controlled nozzle should simply be shut off. Once released, the binding member 28 returns to binding engagement to lock the control member 18 into a new selected position. In FIG. 2A the stop member 32 bindingly engages with the end plate 35 of the spray bar assembly housing to limit the sliding movement of the support member 26. The stop member 32 is positioned at a location along the length of the support member 26 to provide sufficient blocking of the dampening liquid 20, FIG. 1A, spray pattern while also directing at least some of the dampening liquid toward an end of the roller. In FIG. 2B, the stop member 32 is spaced from the end plate 35 to place the control member 18 in the deflecting position as seen in FIG. 1B. The stop member 32 has a locking set screw 34 to selectively lock the stop member 32 at different selected locations along the length of the elongate member 26 for selectively changing the location of the preselected limit point of inward translational movement for the control member 18.

The control member 18 at also has a surface substantially parallel to the elongate support member 26 for directing blocked dampening liquid 20 toward an end of the dampener roller 16. An elongate screw slot 21 enables adjustment of the control member 18 in a direction transverse to the elongate support member 26.

While the advantages of the invention are preferably obtained with the elongate spray bar assembly 12 described above with reference to FIGS. 1A and 1B, the method of the invention can be practiced with any other printing press having a spray bar assembly with a plurality of spaced nozzles for collectively spraying dampening liquid along the length of a dampener roller. Preferably, the direction of at least some of the dampening liquid 20 sprayed toward the dampening roller 16 is controlled by first spraying dampening liquid toward a preselected location on the dampener roller, and then blocking at least some of the dampening liquid sprayed toward the preselected location from impinging upon the dampener roller at that location. The direction of at least some of the dampening liquid is also controlled by movably mounting a control member intermediate the nozzles and the dampening roller for adjustment to different positions along the length of the spray bar assembly, and selectively adjusting the movably mounted control member to different positions to selectively divert at least some of the sprayed dampening liquid onto corresponding different parts of the dampener roller.

Controlling the direction of the dampening liquid 20 sprayed toward the dampener roller 16 is performed while the printing press continues to run by moving the blocking member 18 relative to a nozzle 14 to change the amount of dampening liquid 20 that is sprayed upon the dampener roller 16. Positioned adjustments are made until an optimum result is obtained as determined by observation, and the binding member 28 is released to lock the control member 18 in the correct position.

Preferably, the position of the control member is selected so that at least some of the dampening liquid 20 is deflected onto the dampener roller 16 when the printing press 10 is printing on a relatively wide paper web 50 with an edge adjacent end 16A in comparison to a relatively narrower paper web with an edge 52 spaced from the end 16A of the dampener roller 16. When a relatively narrow web with an edge 52 spaced from the end 16A is being run, preferably the control member 18 is moved to a position in which at least some of the dampening liquid is blocked. The arrangement of the diagonal blocking section 40 and deflection section 42 relative to the spray pattern of dampening liquid 20 is being deflected to the edge of a relatively wide paper web 50 so that the blocking section 40 is not blocking the sprayed liquid 20 which is preferably only done when a narrower web 52 is used and vice versa. By controlling the direction of dampening liquid adjacent the edge of the web, scumming of ink adjacent the edge of the webs of different sizes is thereby achieved.

Thus, the mounted control member 18, in FIG. 1A, diverts at least some of the spraying dampening liquid 20 from the roller 16 by blocking the liquid from the roller. Alternatively, in FIG. 1B, the mounted control member 18 is adjusted by translational movement through use of the actuator handle 24 to selectively divert the spraying dampening liquid 20 by deflecting the liquid from the dampener roller 16. As seen in FIG. 1B, the step of adjusting the movably mounted control member 18 to a position to deflect the dampening liquid 20 onto the dampener roller 16 is performed when the press is running a relatively wide paper web 50. In FIG. 1A, the step of adjusting the movable mounted control member 18 to a position to block at least some of the dampening liquid 20 from impinging upon the dampener roller 16 is performed when the press is using a relatively narrower paper web 52.

While a detailed description of the preferred embodiment of the invention has been given, it should be appreciated that many variations can be made thereto without departing from the scope of the invention as set forth in the appended claims. For example, although adjustment of the position of the control member 18 has been shown performed by manual means, it should be appreciated that such adjustment could also be obtained through the use of remotely controlled servo motors or the like. Also, while a particular shape for the control member 18 and the combination of blocking and deflecting sections into a single control member is preferred, it should be appreciated that other shapes for the control member are capable of functioning. Accordingly, reference should be made to the claims.

We claim:

1. In a printing press having a plate cylinder with a body extending between a pair of opposed ends for supporting a printing plate, a roller and an elongate spray bar assembly with a plurality of spaced nozzles for collectively spraying dampening liquid along the length of the roller, the improvement being a dampening liquid spray control apparatus, comprising:

a dampening liquid control assembly including a blocking member having an edge extending between a pair of opposite sides for blocking at least some of the sprayed dampening liquid from impinging at preselected locations upon the roller and a deflecting member with a deflecting surface spaced from the edge for diverting the sprayed dampening liquid onto preselected locations of the roller, with the deflecting member extending from and being connected to the blocking member; and means for mounting the dampening liquid control apparatus intermediate at least one of the nozzles and the roller to selectively control a pattern of the sprayed dampening liquid upon the roller including means for adjustably mounting the dampening liquid control assembly for movement of both the blocking and deflecting members together relative to the plurality of spaced nozzles to different selected positions at which different amounts of the sprayed dampening liquid are blocked by the blocking member from impinging at different preselected locations upon the dampening roller and the deflecting member directs the sprayed dampening liquid onto different preselected locations on the roller, with the position of the nozzles remaining fixed.

2. The printing press of claim 1 in which said adjustably mounting means includes means for holding the control assembly intermediate the opposed ends of the roller, and an actuator for conveying movement force to the holding means located at a position adjacent one of the ends and spaced from intermediate the opposed ends to enable adjustment of the control assembly relative to the plurality of spaced nozzles during operation of the press.

3. The printing press of claim 1 in which said adjustably mounting means includes an elongate support member extending between a pair of opposed ends, means for attaching the control assembly to the elongate support member at one of the ends, and means for mounting the elongate support member for sliding movement to move the control assembly into different positions along the elongate spray bar assembly.

4. The printing press of claim 3 in which said adjustable mounting means includes means for releasably locking the elongate support member in another preselected position spaced from the preselected position.

5. The printing press of claim 1 in which said mounting means mounts the control assembly adjacent an end of the roller.

6. The printing press of claim 1 including another control assembly, and in which said mounting means includes means for mounting said control assemblies adjacent to respective ones of the opposed ends of the spray bar.

7. The printing press of claim 1 in which the control assembly has a surface for directing blocked dampening liquid toward an end of the roller.

8. The printing press of claim 1 in which said mounting means includes means for mounting the control assembly for movement to a nonblocking position in which spraying dampening liquid is deflected by the deflecting surface onto the dampening roller.

9. The printing press of claim 8 in which said control assembly has a section extending diagonally relative to the elongate direction of the spray bar assembly and extending into a spray pattern of one of said plurality of spray nozzles to block sprayed dampening liquid.

10. In a printing press having a plate cylinder with a body extending between a pair of opposed ends for supporting a printing plate, a roller and an elongate spray bar assembly with a plurality of spaced nozzles for collectively spraying dampening liquid along the length of the roller, the improvement being a dampening liquid spray control apparatus, comprising:

a dampening liquid control member;

means for mounting the dampening liquid control member intermediate at least one of the nozzles and the roller to selectively block at least some of the sprayed dampening liquid from impinging at preselected locations upon the roller including means for adjustably mounting the dampening liquid control member for movement to different selected positions at which different amounts of sprayed dampening liquid are blocked by the control member from impinging at different preselected locations upon the dampening roller;

an elongate support member extending between a pair of opposed ends;

means for attaching the control member to the elongate support member at one of the ends;

means for mounting the elongate support member for sliding movement to move the control member into different positions along the elongate spray bar assembly;

means for releasably locking the elongate support member in another preselected position spaced from the preselected position including a movably mounted binding member, and a spring for biasing the binding member into binding relationship with the elongate support member to hold it in a preselected position.

11. In a printing press having a plate cylinder with a body extending between a pair of opposed ends for supporting a printing plate, a roller and an elongate spray bar assembly with a plurality of spaced nozzles for collectively spraying dampening liquid along the length of the roller, the improvement being a dampening liquid spray control apparatus, comprising:

a dampening liquid control member;

means for mounting the dampening liquid control member intermediate at least one of the nozzles and the roller to selectively block and least some of the sprayed dampening liquid from impinging at preselected locations upon the roller including means for adjustably mounting the dampening liquid control member for movement to different selected positions at which different amounts of sprayed dampening liquid are blocked by the control member from impinging at different preselected locations upon the dampening roller;

an elongate support member extending between a pair of opposed ends;

means for attaching the control member to the elongate support member at one of the ends;

means for mounting the elongate support member for sliding movement to move the control member into different positions along the elongate spray bar assembly;

a stop member carried by the elongate member at a preselected point along its length to provide a preselected limit to the sliding movement of the elongate sliding member; and means for selectively changing the location of the preselected point to change the preselected limit.

12. In a printing press having a plate cylinder with a body extending between a pair of opposed ends for supporting a printing plate a roller and an elongated spray bar assembly with a plurality of spaced nozzles for collectively spraying dampening liquid along the length of the roller, the improvement being an ink spray control apparatus, comprising:

a dampening liquid control assembly with a blocking surface having an edge past which the spraying of dampening liquid from at least one of the nozzles is permitted; and means for mounting the dampening liquid control assembly for movement between different positions to selectively divert at least some of the dampening liquid spraying from the nozzles past the edge onto different parts of the roller including means for adjustably mounting the control assembly comprising an actuating member to control an elongated support member connected to the control assembly for movement of the control assembly longitudinally along the nozzles to different preselected positions at which different amounts of the sprayed liquid are deflected by the control assembly to impinge upon the roller, with the position of the nozzles being fixed, in which the adjustably mounting includes an elongate support member extending between a pair of opposed ends, means for attaching the control member at one of the ends, and means for mounting the elongate support member for sliding movement to move the control member into different positions along the elongate spray bar assembly in which said adjustable mounting means includes means for releasably locking the elongate support member in another preselected position spaced from the preselected position, in which said releasable locking means includes a movably mounted binding member, and a spring for biasing the binding member into binding relationship with the elongate support member to hold it in a preselected position.

13. The printing press of claim 12 in which said adjustably mounting means includes means for holding the control member intermediate the opposed ends of the roller, and an actuator for conveying movement force to the holding means located at a position adjacent one of the opposed ends and spaced from intermediate the opposed ends.

14. The printing press of claim 12 in which said mounting means mounts the control member adjacent an end of the roller.

15. The printing press of claim 12 including another control member, and in which said mounting means includes means for mounting said control members adjacent to respective ones of the opposed ends of the spray bar.

16. The printing press of claim 12 in which the control member has a surface for directing blocked dampening liquid toward an end of the roller.

17. The printing press of claim 12 in which said control member has a deflecting section and a blocking section, and said mounting means includes means for mounting the control member for movement to a nondeflecting position in which the blocking section blocks at least some of the sprayed dampening liquid from impinging at selected locations on the dampener roller.

18. The printing press of claim 17 in which the blocking section extends in a diagonal direction relative to the deflecting section.

19. In a printing press having a plate cylinder with a body extending between a pair of opposed ends for supporting a printing plate a roller and an elongated spray bar assembly with a plurality of spaced nozzles for collectively spraying dampening liquid along the length of the roller, the improvement being an ink spray control apparatus, comprising:

a dampening liquid control assembly with a blocking surface having an edge past which the spraying of dampening liquid from at least one of the nozzles is permitted; and means for mounting the dampening liquid control assembly for movement between different positions to selectively divert at least some of the dampening liquid spraying from the nozzles past the edge onto different parts of the roller including means for adjustably mounting the control assembly comprising an actuating member to control an elongated support member connected to the control assembly for movement of the control assembly longitudinally along the nozzles to different selected positions at which different amounts of the sprayed liquid are deflected by the control assembly to impinge upon the roller, with the position of the nozzles being fixed, in which the adjustably mounting includes an elongate support member extending between a pair of opposed ends, means for attaching the control member at one of the ends, and means for mounting the elongate support member for sliding movement to move the control member into different positions along the elongate spray bar assembly, including a stop member carried by the elongate member at a preselected point along its length to provide a preselected limit to the sliding movement of the elongate sliding member, and means for selectively changing the location of the preselected point to change the preselected limit.

* * * * *